United States Patent [19]

Hildebrandt et al.

[11] Patent Number: 4,697,860

[45] Date of Patent: Oct. 6, 1987

[54] INSULATOR SYSTEM FOR SWITCH TERMINALS

[75] Inventors: Eugene F. Hildebrandt, Ferguson; Thomas V. Ottersbach, Normandy, both of Mo.

[73] Assignee: Emerson Electric Co., St. Louis, Mo.

[21] Appl. No.: 823,619

[22] Filed: Jan. 29, 1986

[51] Int. Cl.[4] ..... H01R 13/64; H01R 13/70

[52] U.S. Cl. ..... 439/374; 200/303; 439/620

[58] Field of Search ..... 339/66 M, 196 M, 198 J, 339/36, 66 R, 147 R, 65; 200/293, 303; 361/355, 361

[56] References Cited

U.S. PATENT DOCUMENTS

| | | | |
|---|---|---|---|
| 3,235,679 | 2/1966 | Schaad et al. | 200/303 |
| 3,966,290 | 6/1976 | Little et al. | 339/17 LC |
| 3,977,748 | 8/1976 | Gruhn et al. | 339/66 M |
| 4,173,387 | 11/1979 | Zell | 339/196 M |
| 4,461,939 | 7/1984 | Sabisch et al. | 200/304 |
| 4,553,801 | 11/1985 | Zajeski | 339/221 R |
| 4,577,917 | 3/1986 | Nashimoto et al. | 339/198 R |

*Primary Examiner*—Gil Weidenfeld
*Assistant Examiner*—Gary F. Paumen
*Attorney, Agent, or Firm*—Polster, Polster and Lucchesi

[57] ABSTRACT

An insulator system for a plurality of male switch terminals protruding from a switch housing. An integrally formed insulative jacket has a skirt extending from the switch housing outwardly past the distal end of the male terminals. The jacket further has means internal of the skirt for frictionally engaging at least one of the male terminals. The jacket has an opening adjacent the distal end of at least one of the male terminals so that a female terminal may be connected to the male terminal. Female terminal has a surrounding insulative jacket which is engagable by the insulative jacket when the male and female terminals are connected, which sleeve, in cooperation with the frictionally engaging means, holds the insulative jacket in place on the switch housing.

7 Claims, 6 Drawing Figures

INSULATOR SYSTEM FOR SWITCH TERMINALS

BACKGROUND OF THE INVENTION

This invention relates to insulators for electrical devices and more specifically to insulators for switch terminals.

Switches are used in appliances such as washing machines to control the electric motor in the appliance in accordance with a predetermined cycle of the appliance. For example, such a switch could be mounted on a washing machine motor to control the operation of the motor in response to commands from the controller of the washing machine. These switches are contained inside the appliance so that the operator of the appliance is unable to touch the switch terminals of the switch during operation of the appliance. Since the switch terminals are electrically isolated from the operator by the appliance itself, the terminals have heretofore been uninsulated. However, during repair of the appliance, the repairman could contact these exposed terminals. It would, therefore, be desirable to insulate the switch terminals.

Any such insulators should be usable with existing switches so that units in the field can be so equipped. It should be appreciated that the space in the interior of an appliance is limited, so the insulators must be of relatively small size. Custom plugs could be used to provide the insulating function, but such plugs are expensive and could have clearance problems with existing appliances. It would of course be undesirable to change the existing design of the appliance merely to accommodate a custom plug.

SUMMARY OF THE INVENTION

Among the various objects and features of the present invention may be noted the provision of an insulator system for switch terminals which is easily retrofitted to existing switches.

Another object of the present invention is the provision of such an insulator system which is easy to install on both new and existing switches.

A third object of the present invention is the provision of such an insulator system which is relatively small in size.

A fourth object of the present invention is the provision of such an insulator system which is relatively low in cost.

Another object of the present invention is the provision of such an insulator system which is usable with existing switches in appliances without modification to either.

Yet another object of the present invention is the provision of such an insulator system which results in relatively simple manufacture of a switch with the insulator system installed.

Other objects and features will be in part apparent and in part pointed out hereinafter.

Briefly, an insulator system of the present invention is designed for use with a plurality of male switch terminals protruding from a switch housing. The insulator system includes an integrally formed insulative jacket having a skirt extending from a switch housing outwardly past the distal end of the male terminals. The jacket further includes means internal of the skirt for frictionally engaging at least one of the male terminals. The jacket has an opening adjacent the distal end of at least one of the male terminals so that a female terminal may be connected to the male terminal. The female terminal has a surrounding insulative sleeve which is engagable by the insulative jacket when the male and female terminals are connected, which sleeve, in cooperation with the frictionally engaging means, holds the insulative jacket in place on the switch housing.

BRIEF DESCRIPTION OF THE DRAWINGS

Similar reference characters indicate similar parts throughout the several views of the drawings.

DESCRIPTION OF THE PREFERRED EMBODIMENT

Figure 1:
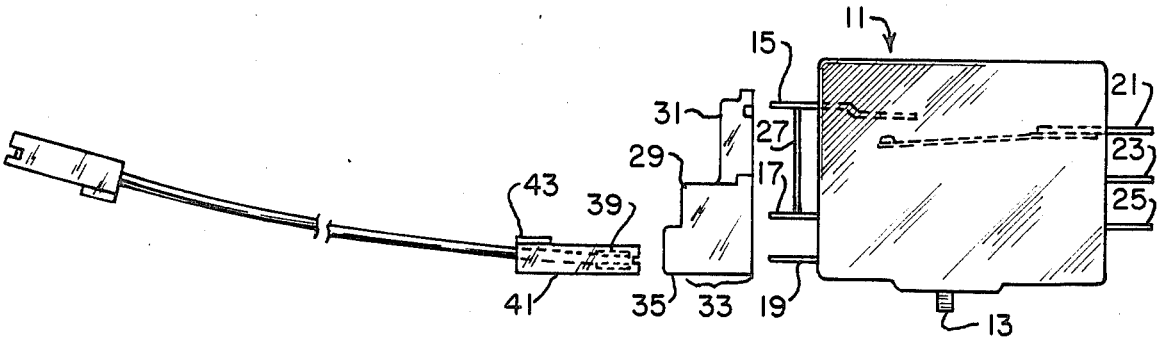
FIG. 1 is an exploded view showing an insulator system of the present invention in combination with a switch.

A conventional switch 11 suitable for use in an appliance such as a washing machine (not shown) includes an actuator 13 for making electrical contact between various sets of male terminals labelled 15, 17, 19, 21, 23, and 25. Switch 11 also includes a bus bar 27 electrically connected between male terminals 15 and 17. An insulative jacket 29 of suitable thermoplastic material is provided to insulate terminal sets 17 and 19 and bus bar 27. A similar jacket couled be provided for terminal sets 21, 23 and 25 if desired.

Insulative jacket 29 includes a cover 31 for covering bus bar 27, a downwardly extending skirt 33 which covers terminals 17 and 19 and a chimney 35 which provides an opening for a terminal of terminal set 19. Skirt 33 is not as tall in the area of bus bar 27 since the bus bar does not extend as far from the housing 37 of the switch as do the male terminals. A female terminal 39 is disposed in an insulative sleeve 41 of suitable thermoplastic material. The insulative sleeve is sized so as to fit in the opening of chimney 35 to make electrical contact between female terminal 39 and male terminal 19. Insulative sleeve 41 includes a protrusion 43 which engages insulative jacket 29 when the insulative jacket is forced away from the switch. Thus the female terminal and protective sleeve provides one means of attaching the insulative jacket to switch housing 37.

Figure 2:
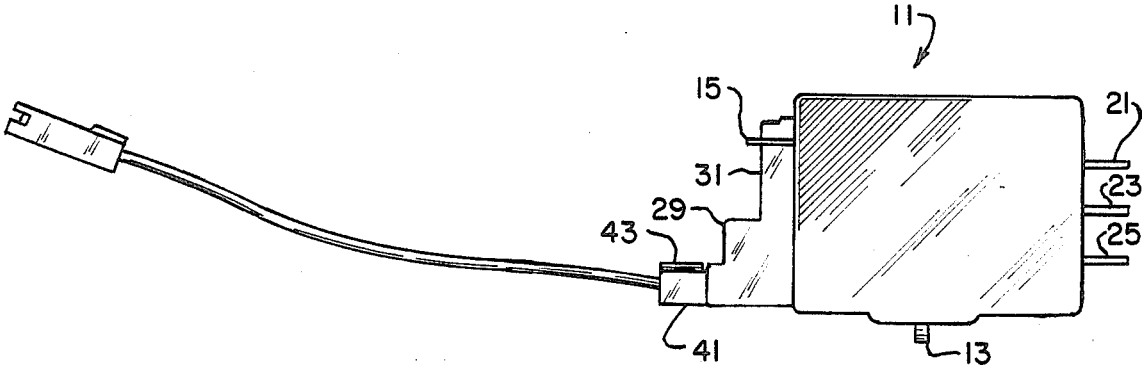
FIG. 2 is a side elevation illustrating an assembled insulator system of the present invention on a switch.

Referring to FIG. 2, insulative jacket 29 is shown secured to the terminals of switch 11 with female terminal 39 and insulative sleeve 41 holding the jacket in place. When so assembled, skirt 31 covers the terminals 17 and 19 and bus bar 27 to prevent them from being touched by a repairman. The skirt extends from switch housing 37 outwardly past the bus bar in the area of cover 31 and past the ends of terminals 17 and 19. Male terminal 15 is not covered by jacket 29 in this particular embodiment of the invention, although it could certainly be covered by a suitably shaped jacket if desired.

Figure 3:
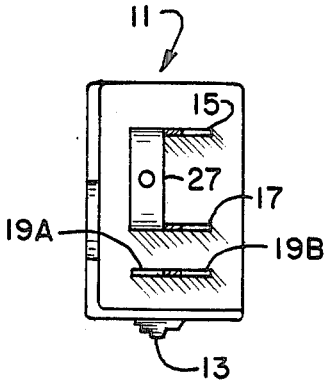
FIG. 3 is a side elevation of the switch shown in FIGS. 1 and 2.

As seen in FIG. 3, terminal set 19 includes a pair of terminals 19A and 19B while terminal set 17 includes a single terminal 17. In the particular embodiment of the invention shown, electrical connection from the appliance need be made only with terminals 15 and 19B. So all of the other terminals except for terminal 15 are covered by insulative jacket 29.

Figure 4:
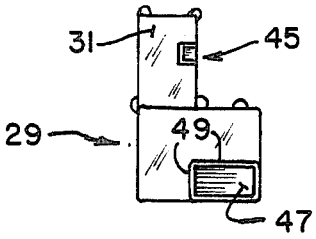
FIG. 4 is a top plan of insulator jacket of the present invention.

As seen in plan (FIG. 4) isulative jacket 29 is generally L-shaped with cover 31 forming the top portion of the back of the L. Cover 31 also has integrally formed therein a latch 45. Also shown in FIG. 4 is opening 47 which permits insulative sleeve 41 to pass through the insulative jacket so that the female terminal 39 can make contact with male terminal 19B. The walls 49 which define opening 47 are engagable by protrusion 43 of the insulative sleeve to hold the insulative jacket on the switch housing 37. In addition, latch 45 holds the insulative jacket to bus bar 27.

Figure 5:
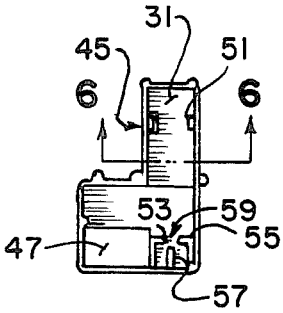
FIG. 5 is a bottom plan of the insulator jacket of FIG. 4.

Insulative jacket 29 is generally hollow and is one integrally formed piece. As shown in FIG. 5, the hollow interior of jacket 29 includes a ramp 51 disposed on one wall of cover 31 and opposed from latch 45. Insulative jacket 29 which further includes a set of three internal ribs 53, 55, and 57 which define a receiving slot 59 for male terminal 19A. The width of slot 59 is slightly smaller than the width of terminal 19A so that as the insulative jacket 29 is pushed down over the terminals, ribs 53, 55, and 57 frictionally engage male terminal 19A to help hold the insulative cover in place. These ribs extend down generally to the base of insulative cover 29.

Figure 6:
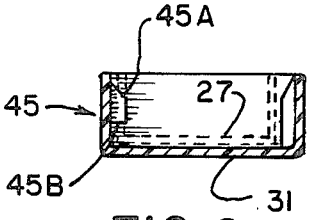
FIG. 6 is a cross-sectional view on an enlarged scale taken along line 6—6 of FIG. 5.

Turning to FIG. 6, bus bar 27 is seen to be generally C-shaped having a pair of legs connected by a flat back portion. The bus bar is latched by latch 45 as follows. Latch 45 includes a ramp 45A upon which rides bus bar 27 as the cover is pressed down over the bus bar. This ramp along with ramp 51 force the sides of cover 31 apart to permit the bus bar to enter cover 31. Latch 45 also includes an undercut 45B disposed near the top of cover 31. When the bus bar encounters this undercut, the cover snaps into the position shown in FIG. 6 around bus bar 27, thereby holding it in place.

In view of the above it will be seen that the various objects and features of the present invention are achieved and other advantageous results obtained.

As various changes could be made in the above constructions without departing from the scope of the invention, it is intended that all matter contained in the above description and shown in the accompanying drawings shall be interpreted as illustrative and not in a limiting sense.

What is claimed is:

1. An insulator system for a plurality of male switch terminals protruding from a switch housing comprising an integrally formed insulative jacket having a skirt extending from the switch housing outwardly past the distal end of the male terminals to a relatively closed jacket top, said jacket being separate from the switch housing, the jacket further having means internal of the skirt for frictionally engaging at least one of the male terminals, the jacket top defining an opening adjacent the distal end of at least one of the male terminals so that a female terminal may be connected through the opening in the jacket top to the male terminal, the female terminal having a surrounding insulative sleeve engageable by the insulative jacket top when the male and female terminals are connected, which sleeve, in cooperation with the frictionally engaging means, holds the insulative jacket in place on the switch housing.

2. The insulating system as set forth in claim 1 wherein the distal end of the female terminal sleeve fits freely inside the opening in the top of the insulating jacket, the sleeve having a protrusion toward the proximal end thereof which is engageable by the jacket top to prevent the jacket from being removed from the male terminals while the female terminal is connected to its male terminal.

3. The insulator system as set forth in claim 2 wherein the jacket includes a chimney extending distally out from the switch housing, which chimney defines the opening in the insulative jacket, the chimney terminating at a distance from the switch housing generally corresponding to the protrusion on the female terminal sleeve when the female terminal is connected to the male terminal.

4. The insulator system as set forth in claim 1 wherein the frictionally engaging means includes a receiving slot defined by a plurality of internal ribs of the jacket, the receiving slot being somewhat smaller in width than the male terminal and wherein two the male terminals are disposed side-by-side in a pair, the opening in the jacket being adjacent the distal end of a male terminal of the pair and the receiving slot of the jacket being spaced from the opening a predetermined distance so as to engage the other male terminal of the pair.

5. The insulator system as set forth in claim 1 wherein the switch housing includes a C-shaped bus bar having a pair of legs connected to the switch housing and a base extending between the legs and spaced from the switch housing, said insulative jacket including a cover for the bus bar to isolate it and wherein the cover includes an integrally formed latch to latch the insulative jacket to the base of the bus bar.

6. The insulator system as set forth in claim 5 wherein the latch includes a pair of ramps to force apart the sides of the cover as the insulative jacket is placed over the bus bar and male terminals.

7. The insulator system as set forth in claim 6 wherein at least one of the ramps has an undercut sufficient in size to contain the bus bar base so that as the cover is pushed over the bus bar, the bus bar base slips into the undercut and is held therein by the ramp.

* * * * *